US010202749B2

(12) United States Patent
Hall et al.

(10) Patent No.: US 10,202,749 B2
(45) Date of Patent: Feb. 12, 2019

(54) WATER JET WASTE FRAGMENTING APPARATUS

(71) Applicants: David R. Hall, Provo, UT (US); Justin Robinson, Provo, UT (US); Kevin Cheatham, Provo, UT (US); Eric Magleby, Provo, UT (US)

(72) Inventors: David R. Hall, Provo, UT (US); Justin Robinson, Provo, UT (US); Kevin Cheatham, Provo, UT (US); Eric Magleby, Provo, UT (US)

( * ) Notice: Subject to any disclaimer, the term of this patent is extended or adjusted under 35 U.S.C. 154(b) by 0 days.

(21) Appl. No.: 15/222,497

(22) Filed: Jul. 28, 2016

(65) Prior Publication Data

US 2018/0030710 A1 Feb. 1, 2018

(51) Int. Cl.

| | |
|---|---|
| ***E03D 5/01*** | (2006.01) |
| ***E03D 9/10*** | (2006.01) |
| ***E03D 5/08*** | (2006.01) |
| ***E03D 5/09*** | (2006.01) |

(52) U.S. Cl.

CPC ..... *E03D 9/10* (2013.01); *E03D 5/01* (2013.01); *E03D 5/08* (2013.01); *E03D 5/09* (2013.01); *E03D 2201/30* (2013.01)

(58) Field of Classification Search

CPC ..... E03D 9/10
USPC ..... 4/421, 425, 255.01–255.11
See application file for complete search history.

(56) References Cited

U.S. PATENT DOCUMENTS

| | | | | |
|---|---|---|---|---|
| 3,731,877 | A * | 5/1973 | Nekrasov | B05B 17/0692 239/266 |
| 5,657,496 | A * | 8/1997 | Corb | A61H 33/027 239/587.1 |
| 8,057,413 | B2 * | 11/2011 | Katsukawa | A61H 35/006 239/263.1 |
| 2003/0074731 | A1 * | 4/2003 | Sumino | A47K 13/10 4/667 |
| 2005/0015871 | A1 * | 1/2005 | Tomita | E03D 3/00 4/425 |
| 2009/0211008 | A1 * | 8/2009 | Fucito | E03D 9/00 4/345 |
| 2013/0305444 | A1 * | 11/2013 | Boodaghians | E03D 5/003 4/323 |

FOREIGN PATENT DOCUMENTS

JP 03090755 A * 4/1991

OTHER PUBLICATIONS

English abstract of JP 03090755 A printed Aug. 18, 2017.*

* cited by examiner

*Primary Examiner* — Christine J Skubinna

(57) ABSTRACT

A waste fragmenting toilet apparatus with pressurized water jets is disclosed. The apparatus includes a toilet bowl, a toilet trap, a water supply, and a plurality of oscillating water jet nozzles. The oscillating water jet nozzles are located within line of sight of recurrent waste blockage zones, interior to the toilet trap and/or toilet bowl. When actuated, the oscillating water jet nozzles inject pressurized water into a trap area breaking up waste material as it passes through. The oscillating water jet nozzles may be used to preemptively prevent blockages and to remove existing blockages.

18 Claims, 15 Drawing Sheets

WATER JET WASTE FRAGMENTING APPARATUS

TECHNICAL FIELD

The present invention relates generally to an integrated toilet system for removing or preventing waste obstructions. More particularly the present invention relates to using fluid means to unblock or prevent blockages in a toilet system.

BACKGROUND

It is common for current toilet systems to become blocked by waste. Often the waste which clogs a toilet is hard and unyielding, clinging to the walls of toilet traps. This can cause toilets to overflow, and impedes their use. Many methods and apparatuses in the art have employed the use of variations of plungers. The use of plungers and other external apparatuses present a number of problems concerning sanitation and ease of use. Sanitation is a problem because after an apparatus is removed from the toilet, it has unsanitary water and waste material clinging to one or more of its surfaces. Additionally, while in use, many plungers cause splashes of contaminated water to exit toilet bowls.

For users who don't have an external apparatus conveniently located with respect to the toilet, it is sometimes inconvenient and/or embarrassing to retrieve it. Another problem presents itself for users of lesser skill or physical agility, which may find it difficult to use an external apparatus, such as, for example, a toilet plunger.

SUMMARY OF THE INVENTION

A waste fragmenting toilet apparatus with pressurized water jets is disclosed which overcomes or improves upon the problems discussed above. In general, the apparatus includes a toilet bowl, a toilet trap, a water supply, and a plurality of water jet nozzles. The water jet nozzles are located within line of sight of recurrent waste blockage zones, interior to the toilet trap and/or toilet bowl. When actuated, the water jet nozzles inject pressurized water into the waste blockage zones, which weakens and/or fragments any blockages. Subsequently, a water pressure head, vacuum, pressurized air, or other means are used to flush the weakened and/or fragmented waste out of the trap and/or toilet bowl.

Due to the integral nature of the apparatus with respect to a toilet, unsanitary water and other waste that may otherwise splash out of the toilet bowl are flushed down the toilet. Additionally, the apparatus is easy to use and requires little, if any, physical agility or skill to actuate.

In one embodiment, a waste fragmenting toilet is disclosed that includes a toilet bowl, a toilet trap, and a water supply. The toilet bowl includes a bottom which is coupled to a toilet trap. The toilet trap includes a plurality of oscillating water jet nozzles positioned along one or more walls of the toilet trap. The water supply includes one or more controllable water valves. The controllable water valves control water flow to the plurality of oscillating water jet nozzles. The plurality of oscillating water jet nozzles may inject pressurized water into the toilet trap in an oscillating arc or pattern.

BRIEF DESCRIPTION OF THE DRAWINGS

A more particular description of the invention briefly described above is made below by reference to specific embodiments. Several embodiments are depicted in drawings included with this application, in which.

DETAILED DESCRIPTION

A detailed description of the claimed invention is provided below by example, with reference to embodiments in the appended figures. Those of skill in the art will recognize that the components of the invention as described by example in the figures below could be arranged and designed in a wide variety of different configurations. Thus, the detailed description of the embodiments in the figures is merely representative of embodiments of the invention, and is not intended to limit the scope of the invention as claimed.

In some instances, features represented by numerical values, such as dimensions, mass, quantities, and other properties that can be represented numerically, are stated as approximations. Unless otherwise stated, an approximate value means "correct to within 50% of the stated value." Thus, a length of approximately 1 inch should be read "1 inch+/−0.5 inch."

Figure 1:
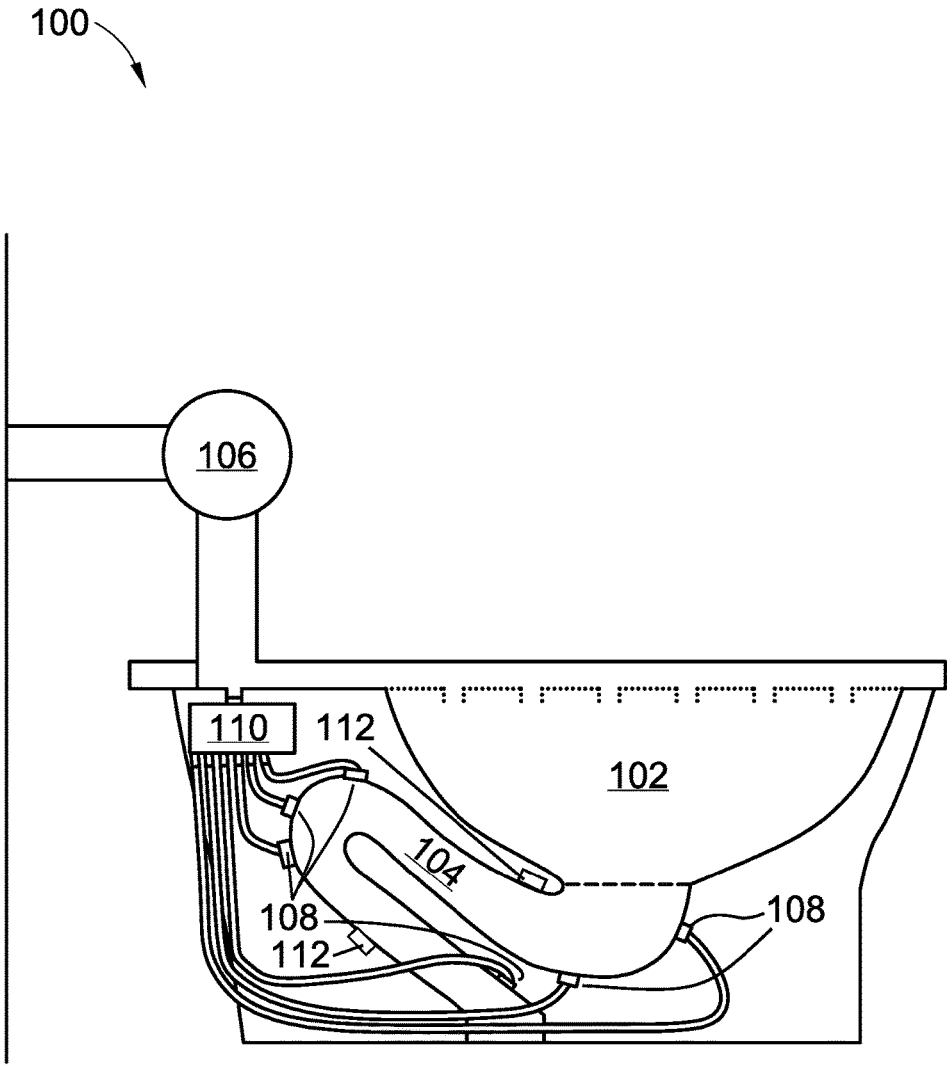
FIG. 1 depicts a side view of a waste fragmenting toilet apparatus with oscillating water jet nozzles.

FIG. 1 depicts a side view of a waste fragmenting toilet apparatus with oscillating water jet nozzles 108. Toilet apparatus 100 includes toilet bowl 102, toilet trap 104, and water supply 106. Toilet bowl 102 includes a bottom which is coupled to toilet trap 104. Toilet trap 104 includes a plurality of oscillating water jet nozzles 108 positioned along the toilet trap 104. Water supply 106 includes one or more controllable water valves 110 that control water flow to the plurality of oscillating water jet nozzles 108, wherein the plurality of oscillating water jet nozzles 108 inject pressurized water into toilet trap 104 in an oscillating arc or pattern. The oscillating water jets 108 may be formed of compliant orifices which oscillate due to water pressure bending and moving the compliant orifices causing an oscillating arc or pattern.

When the waste fragmenting toilet apparatus 100 is actuated, water valves 110 receive pressurized water from water supply 106. Water valves 110 then distribute the water to oscillating water jet nozzles 108. Subsequently, nozzles 108 may inject water in a stream in sequential directions, one direction at a time per nozzle 108, along their respective arcs. In other words, when actuated, each nozzle 108 may inject a single beam of water into toilet trap 104 at any instant in a downstream drainage direction. Over a period of time, the angle of each nozzle 108 changes and so the direction of its corresponding beam of water changes, while the location of each nozzle 108 stays the same. Due to the oscillating movement of each nozzle 108, it traces out the same path repeatedly over a period of time; in this way, the water injected from nozzles 108 may impact any waste present in the same locations repeatedly, rapidly eroding parts of the waste until it is sufficiently eroded to be forced down toilet trap 104 by a pressure head, siphon jet, pressure difference, and/or other means used to flush toilet apparatus 100.

In some embodiments, the oscillating arcs of nozzles 108 include angles between 0 and 90 degrees with respect to a direction which is normal to a surface whereon a respective water jet nozzle of the plurality of oscillating water jet nozzles is positioned.

In some embodiments, nozzles 108 change the angles of their respective fluid streams simultaneously, sequentially, and/or selectively depending on location of a waste blockage.

In some embodiments, nozzles 108 inject water in an oscillating arc because each nozzle 108 includes a compliant member, integral to nozzle 108, which vibrates at a certain frequency. The frequency at which the compliant member vibrates changes a range of motion of the oscillating arc of each nozzle 108. The frequencies of vibration are dependent on the pressures and flow rates of the water which is injected by nozzles 108. In another embodiment, nozzles 108 inject water in an oscillating arc enabled by integrated servo motors included in each nozzle.

In some embodiments, nozzles 108 inject pressurized water into toilet trap 104 in a circular arc, the injected water cleaning the one or more walls of toilet trap 104 while impinging on any waste blockages.

Controllable water valves 110 are controlled using any of a variety of means including a continuously rotating shaft, a valve manifold, a pressure difference, etc. In embodiments using a continuously rotating shaft to control valves 110, the rotating shaft is driven by a motor which is connected to a power supply. When the power supply is attached, or when a power switch is closed, the shaft rotates. At specific shaft angles or over shaft angle ranges, different valves 110 are opened or closed to allow water to flow to their respective nozzles 108. Additionally, in some embodiments, the rotating shaft is powered manually.

In some embodiments using a valve manifold to control valves 110, the valve manifold uses solenoids which open and close valves 110. In these embodiments, the valve manifold includes a power source to energize the solenoids and to power circuitry that switches the solenoids for different valves 110 on and off. In some further embodiments, the circuitry includes one or more processors and memory.

In some embodiments using a pressure difference to control valves 110, when valves 110 are pressurized using water pressure from any of a variety of sources including water supply 106, a manually actuated pressure, a mechanical pump, etc., one or more of valves 110 open or close. This may be accomplished using any of a variety of means including a diaphragm, one or more pressure sensors, pistons, etc.

In some embodiments using a diaphragm, when the diaphragm is strained it also pushes and/or pulls open valves 110. In some embodiments using pressure sensors, the sensors, by means of a wire or wirelessly, communicate a pressure to circuitry which will open and/or close valves 110. The pressure is communicated and utilized by any of a variety of means, including via a voltage difference, a change in current, a change in capacitance, a change in inductance, a change in resistance, a time rate of change of any of the preceding, etc. The circuitry often includes one or more power sources. In a further embodiment, a pressure sensor receives power from a power source. The sensor's output is a voltage difference which is proportional to the pressure. This output is connected to a base of a transistor, which signal is amplified and used to supply voltage to a solenoid to open valves 110. In some embodiments using pistons, as water pressure increases or decreases, the pistons change their positions. These changes in position are used to actuate the opening and closing of valves 110.

In one embodiment, for example, a piston is positioned inside a hollow shaft, sealing one side of the shaft from the other. The shaft is connected at one end to a body of water connected to water supply 106 and at the other end the shaft includes a compressible gas which is isolated by a closed end of the shaft. The piston separates the gas from the water, and moves in one direction toward the gas when the water pressure increases. The piston moves toward the water side of the shaft when the water pressure decreases. The piston is connected to valve 110 by means such as a wire, chain, connecting rod, etc. such that when the water pressure increases, the piston moves toward the gas and valve 110 opens. When the water pressure decreases, the piston moves toward the water and valve 110 closes.

In some embodiments using a pressure difference to control valves 110, pressure sensors 112 are included in toilet trap 104, which are positioned on walls of toilet trap 104, in locations between oscillating water jet nozzles 108. These sensors 112 are used to determine where a waste blockage is located, as a sensor on one side of the blockage will read a different pressure than that on another side of the blockage. For example, in some embodiments, valves 110 include a microcontroller which includes instructions for determining a location of a blockage based on pressure readings. The microcontroller also includes instructions for opening or closing solenoids, which then control valves 110 based upon the location of the blockage. Valves 110 also often include a power source for powering the solenoids, the pressure sensors, and the microcontroller.

In the depicted embodiment, the one or more valves 110 are placed in the same location. In some embodiments, this is done with a valve manifold. In some other embodiments, valves 110 are positioned in different locations within toilet apparatus 100. In yet other embodiments, water supply 106 includes a number of valves 110 equivalent to a total number of oscillating water jet nozzles 108, such that each valve 110 controls flow of water to a different water jet nozzle 108.

In the depicted embodiment, toilet apparatus 100 includes 6 oscillating water jet nozzles 108 positioned along toilet trap 104. Nozzles 108 are positioned at intervals to enable better coverage of all of toilet trap 104. In some embodiments, nozzles 108 are positioned such that a waste blockage at any position within toilet trap 104 can be impinged upon by water from nozzles 108 injected in a direction which coincides with a direction of water flow when toilet apparatus 100 is flushed. This is for the purpose of increasing a pressure difference between an impinged side of the blockage and an opposite side of the blockage.

In some embodiments, water supply 106 connects directly to a potable water line with a water pressure great enough to flush waste in toilet bowl 102 and toilet trap 104 down a drain. In some other embodiments, water supply 106 connects directly to a gray water line. In such embodiments, water from the gray water line may need to be filtered sufficiently so as to not block or cause undue sediment buildup on valves 110 or nozzles 108.

In some embodiments, the water pressure in a water line connected to water supply 106 isn't great enough on its own to flush waste in toilet bowl 102 and toilet trap 104 down the drain. In such embodiments toilet apparatus 100 includes an elevated body of water, a pressurized body of fluid, and/or a vacuum-assisted flushing system in order to help with flushing. In some embodiments, in addition to oscillating water jet nozzles 108, toilet trap 104 includes a siphon jet which actuates upon flushing toilet apparatus 100.

Oscillating water jet nozzles 108 inject water with a kinetic energy. In embodiments where the kinetic energy of the water is great enough to cut through materials of toilet trap 104 and/or toilet bowl 102, a material of higher wear resistance is included in regions where the injected water strikes toilet trap 104 and/or toilet bowl 102. In one embodiment, the material included in regions where the injected water strikes toilet trap 104 is made of silicon carbide (SiC). In another embodiment, toilet bowl 102 and toilet trap 104 are comprised of a more erosion and wear resistant ceramic material than porcelain, such as fused alumina ($Al_2O_3$).

In some embodiments, toilet trap 104 includes a last water jet nozzle of oscillating water jet nozzles 108 which injects water in a direction toward a drain exit of toilet trap 104. In some further embodiments, the last water jet nozzle injects water with such a high kinetic energy that the water that impinges waste and any piping connected to the drain exit of toilet trap 104 pierces any of a variety of pipe materials common to such systems that it impinges on, such as polyvinyl chloride (PVC), acrylonitrile butadiene styrene (ABS), 316 stainless steel, etc. In such embodiments, the piping impinged upon includes sections or interior coverings made of high erosion and wear resistant materials, such as SiC, fused $Al_2O_3$, titanium nitride (TiN), etc. In some other further embodiments, the last water jet nozzle injects water in a circle pattern, or other pattern, in order to cut away any obstructions which are lodged at and/or near the drain exit of toilet trap 104. Some examples of items which are commonly lodged at the drain exit include children's toys, baby wipes, feminine hygiene products, needles, cigarette butts, sanitary napkins, and elastomer items such as latex balloons or nitrile gloves.

Figure 2:
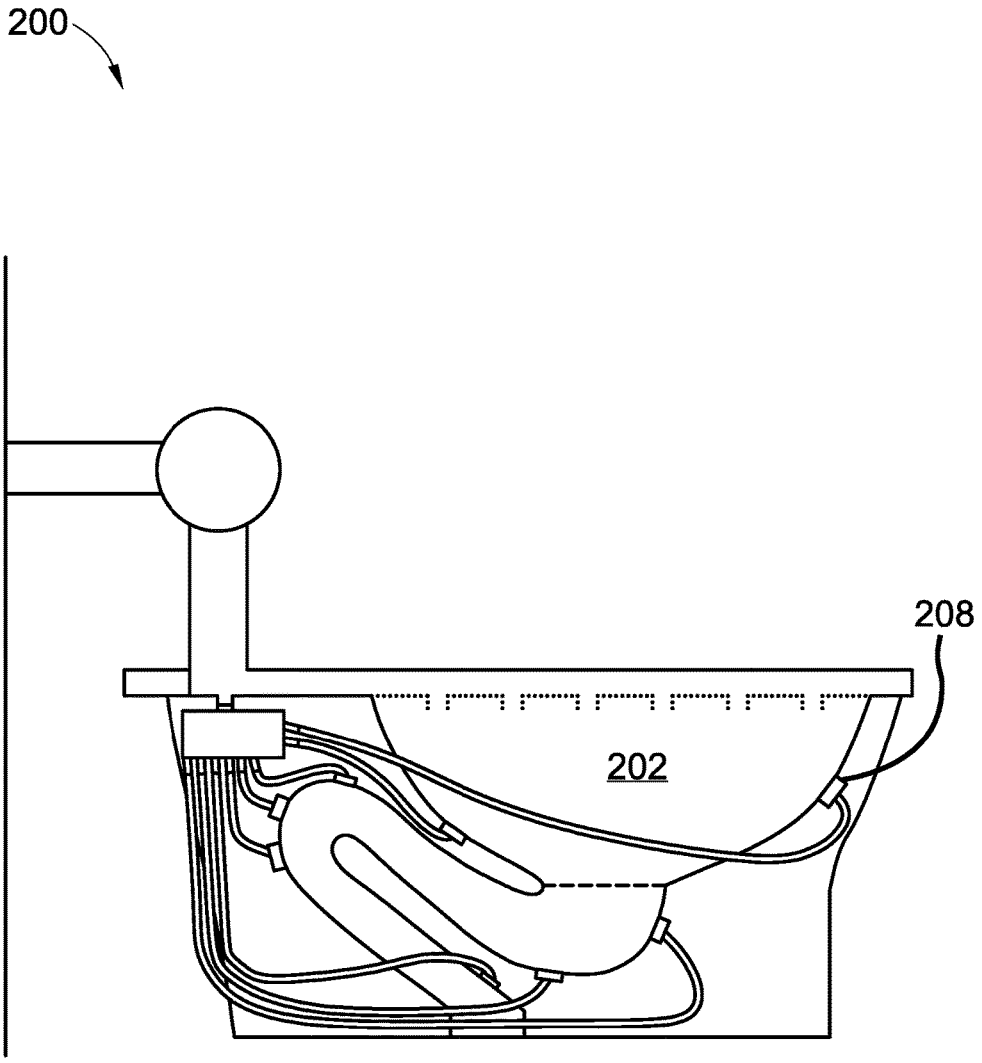
FIG. 2 depicts an embodiment similar to FIG. 1, additionally including oscillating water jet nozzles in a toilet bowl.

FIG. 2 depicts an embodiment similar to FIG. 1, additionally including oscillating water jet nozzles in a toilet bowl. Toilet apparatus 200 includes toilet bowl 202. Toilet bowl 202 includes one or more oscillating water jet nozzles 208 positioned along one or more walls of toilet bowl 202. Oscillating water jet nozzles 208 inject pressurized water into toilet bowl 202 in an oscillating arc. In addition to breaking up waste blockages, in some embodiments, oscillating water jet nozzles 208 inject pressurized water in an oscillating arc such that the injected water cleans the surface of toilet bowl 202.

Figure 3:
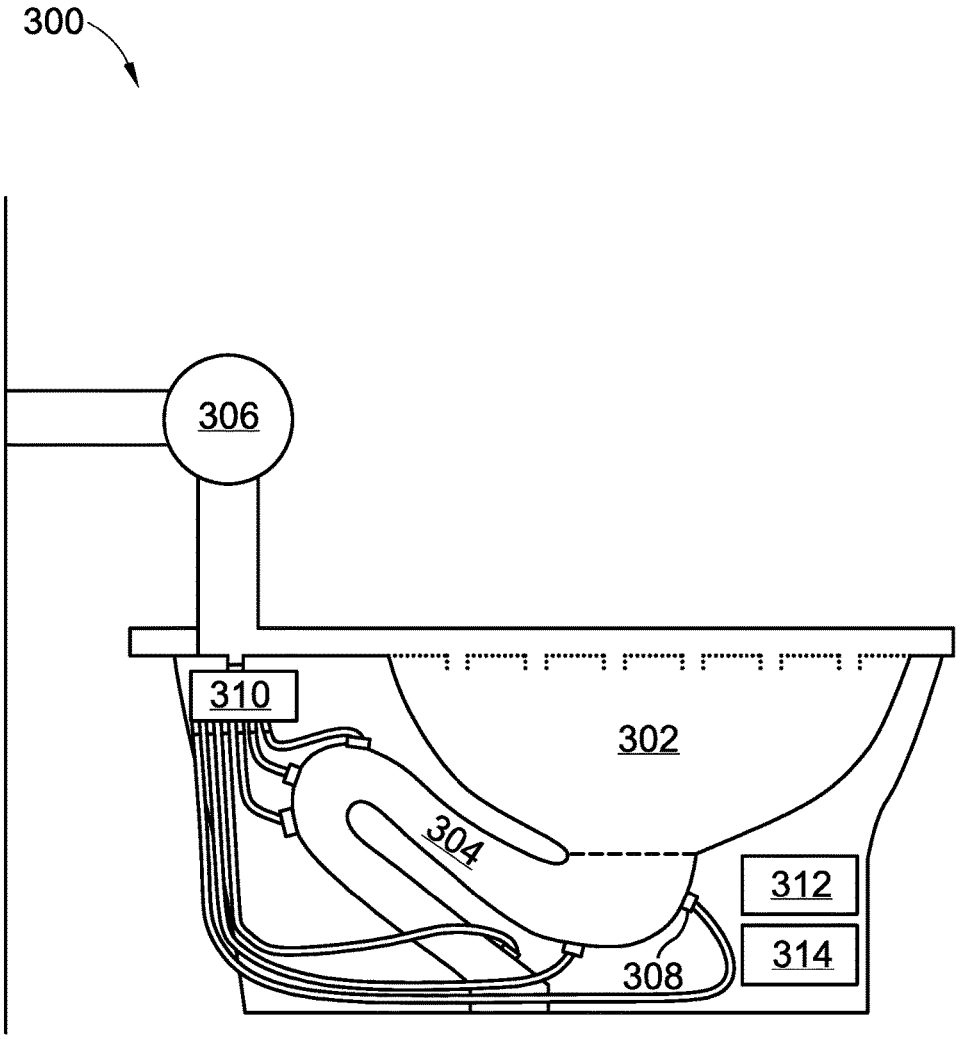
FIG. 3 depicts an embodiment similar to FIG. 1, including some electronic components.

FIG. 3 depicts an embodiment similar to FIG. 1, including some electronic components. Toilet apparatus 300 includes one or more processors 312 and memory 314.

Figure 4:
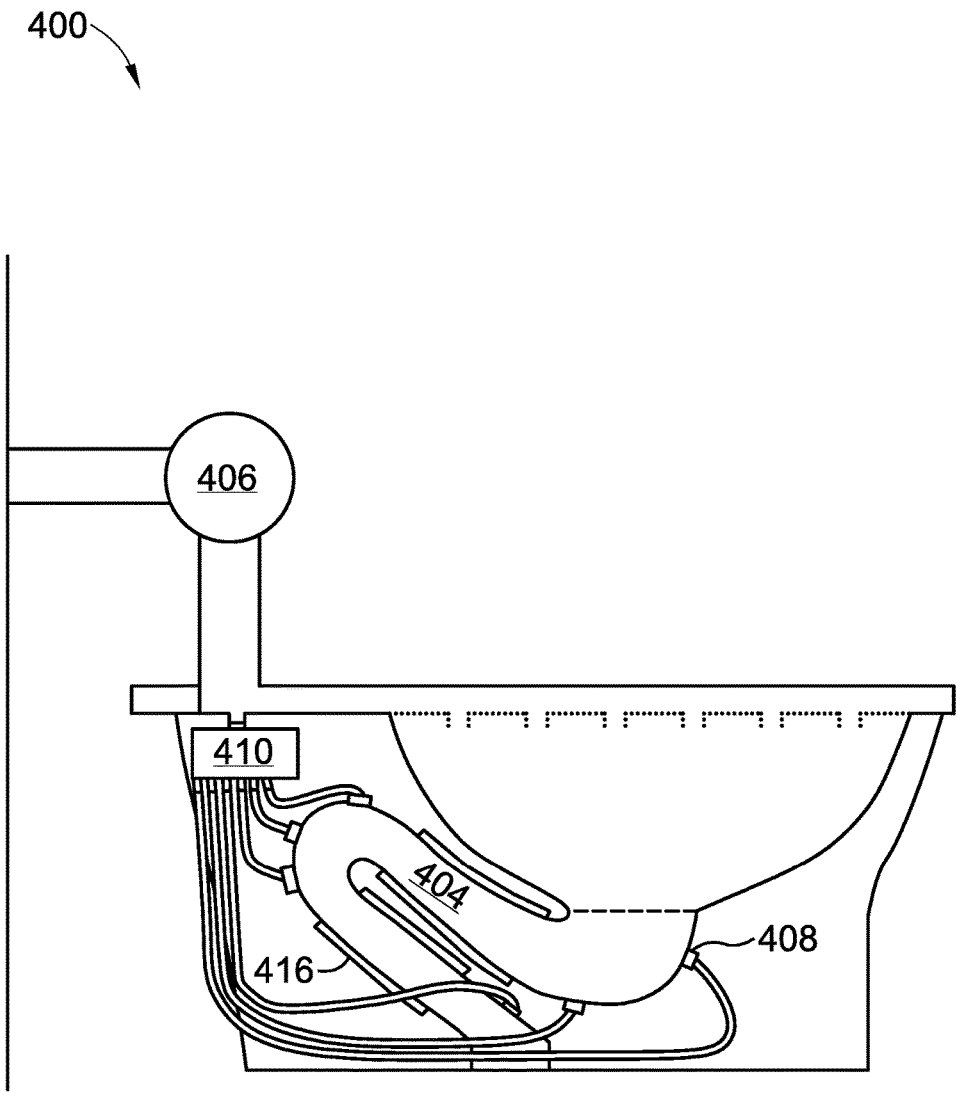
FIG. 4 depicts an embodiment similar to FIG. 1, including capacitive sensors.

FIG. 4 depicts an embodiment similar to FIG. 1, including capacitive sensors. Toilet apparatus 400 includes toilet trap 404, water supply 406, and capacitive sensors 416 positioned on and/or in walls of toilet trap 404. Toilet trap 404 includes one or more oscillating water jet nozzles 408. Water supply 406 includes one or more controllable water valves 410. When a waste blockage is located in toilet trap 404 between a first set of capacitive sensors 416, the first set of capacitive sensors 416 has a different capacitance than when no waste blockage is located between the first set. This is similarly true with a second set, a third set, etc. In this way, capacitive sensors 416 are used to determine general locations of waste blockages within toilet trap 404. In some embodiments, for example, a change in capacitance of a set of capacitive sensors 416 is found using electronic components such as those found in a capacity meter. This information is then used to actuate one or more valves 410 via other electric circuitry, which cause certain nozzles 408 to inject water into toilet trap 404. For example, in a further embodiment, toilet apparatus 400 includes a microcontroller which includes instructions for controlling valves 410.

Figure 5:
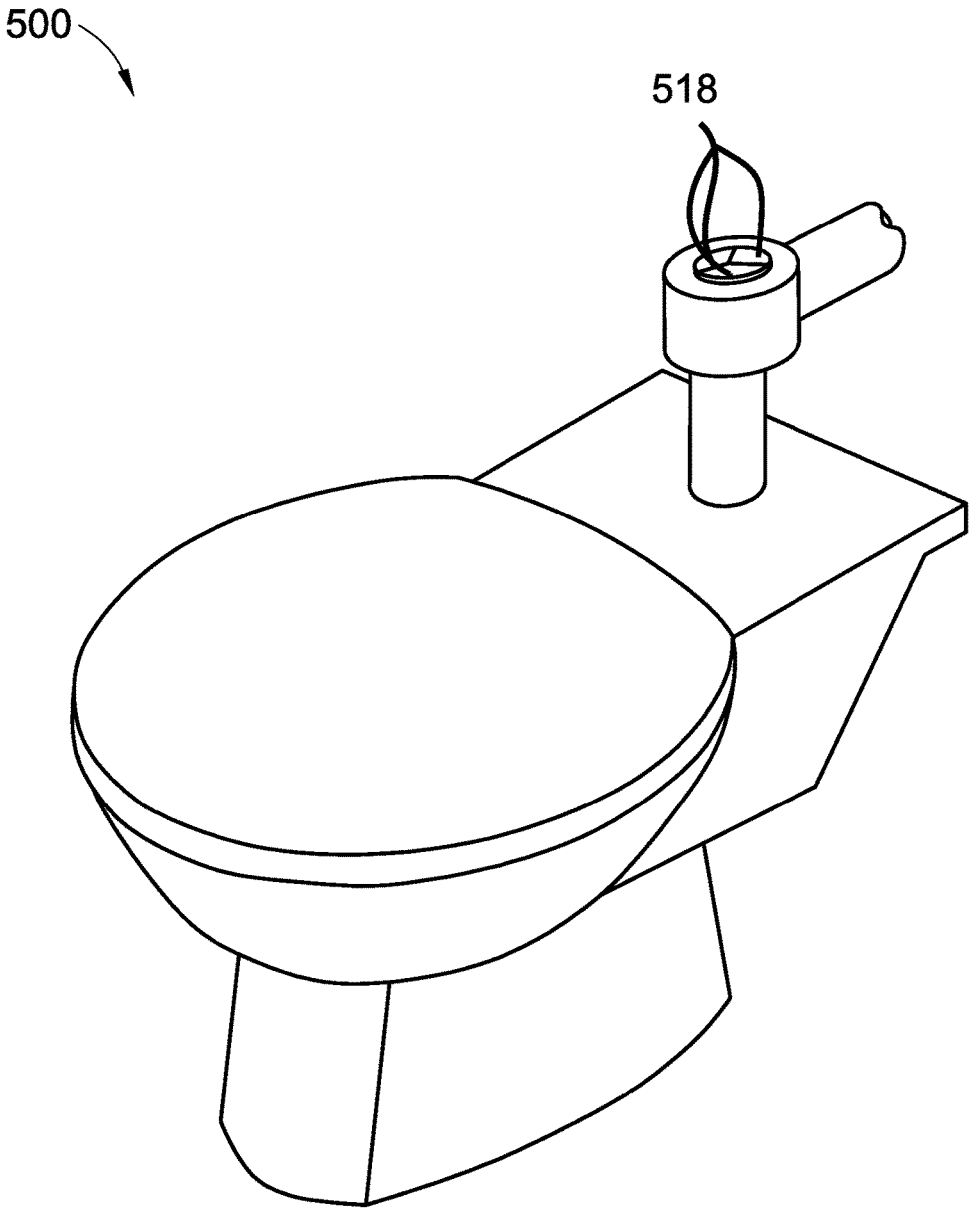
FIG. 5 depicts a perspective view of a waste fragmenting toilet apparatus with buttons.

FIG. 5 depicts a perspective view of a waste fragmenting toilet apparatus with buttons. Toilet apparatus 500 includes one or more tactile control buttons 518 and a plurality of oscillating water jet nozzles (not shown) which inject pressurized water into a toilet trap (not shown). Control buttons 518 actuate the oscillating water jet nozzles when depressed. In the depicted embodiment, toilet apparatus 500 includes three control buttons 518 which each have a different function. In a further embodiment, the three buttons 518 flush toilet apparatus 500, actuate all nozzles, and actuate each nozzle one at a time in a pattern beneficial to flushing, respectively.

Figure 6:
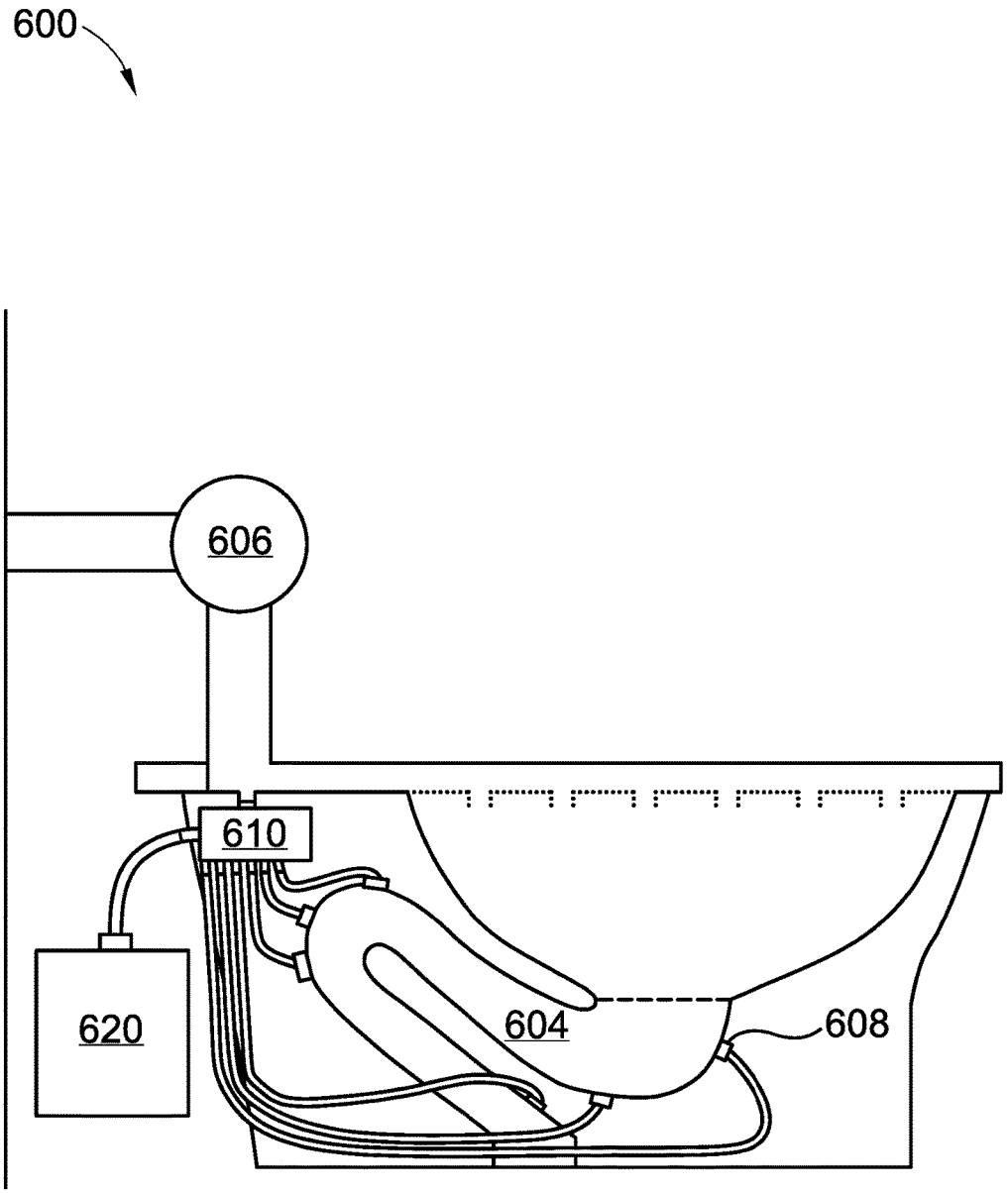
FIG. 6 depicts an embodiment similar to FIG. 1, additionally having an enzyme reservoir.

FIG. 6 depicts an embodiment similar to FIG. 1, additionally having an enzyme reservoir. Toilet apparatus 600 includes enzyme reservoir 620, water supply 606, and toilet trap 604. Water supply 606 includes one or more controllable water valves 610. Toilet trap 604 includes a plurality of oscillating water jet nozzles 608. Enzyme reservoir 620 includes a concentrated enzyme solution which breaks down fecal and other waste matter. Enzyme reservoir 620 is coupled to valves 610 such that water from water supply 606 is mixed with the concentrated enzyme solution to form a less concentrated enzyme solution. The less concentrated enzyme solution is then injected into toilet trap 604 via nozzles 608. This less concentrated enzyme solution then partially or completely breaks down waste in toilet trap 604. Additionally, the less concentrated enzyme solution continues to break down waste in subsequent waste pipes such as a drain and sewer. This decreases the amount of breaking down waste from toilet apparatus 600 which is needed to be done in a septic system and/or in a reclamation plant. Since nozzles 608 inject the less concentrated enzyme solution into the toilet trap in an oscillating arc (as described previously), the enzyme solution also mixes more fully with waste in toilet trap 604, increasing the efficiency of the enzymes' processes of breaking down waste.

Figure 7:
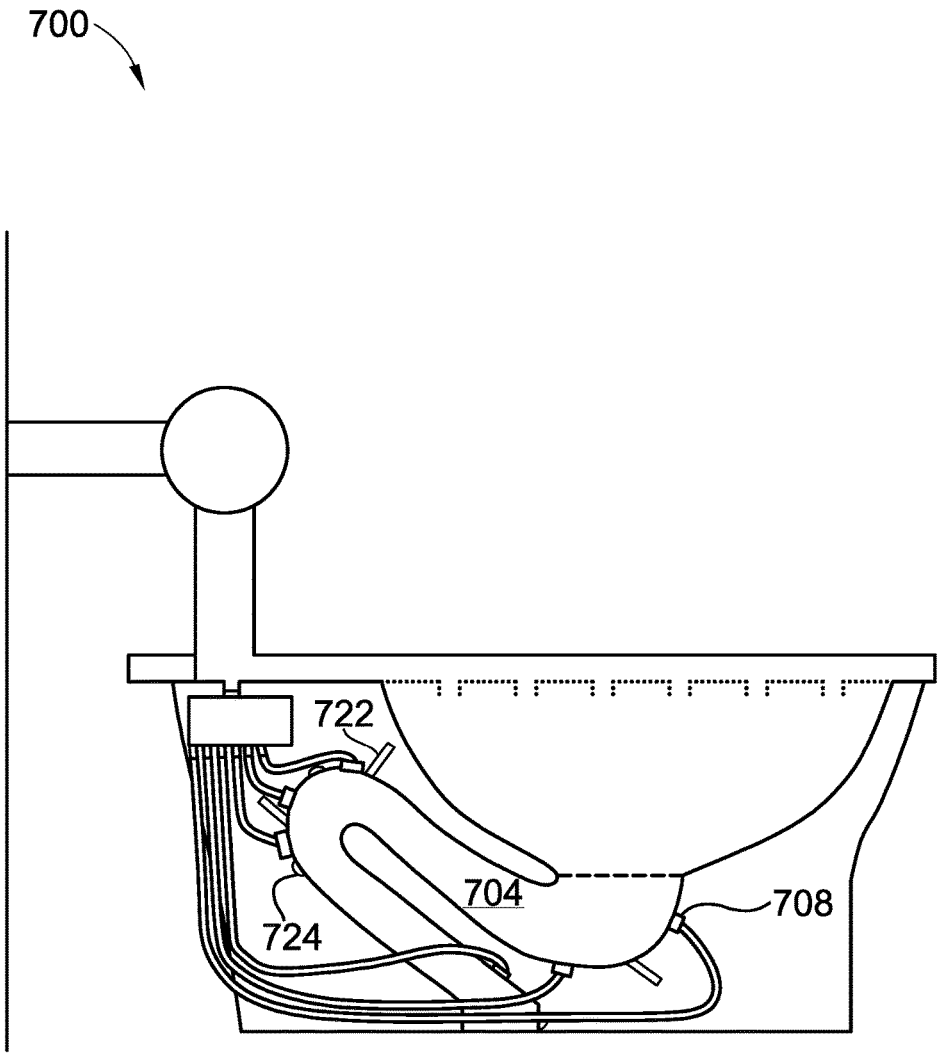
FIG. 7 depicts an embodiment similar to FIG. 1, additionally including infrared lights and sensors.

FIG. 7 depicts an embodiment similar to FIG. 1, additionally including infrared lights and sensors. Toilet apparatus 700 includes toilet trap 704. Toilet trap 704 includes a plurality of oscillating water jet nozzles 708, one or more infrared (IR) lights 722 (meaning infrared light emitting devices), and one or more infrared (IR) light sensors 724 positioned on one or more walls of toilet trap 704. IR lights 722 each contain an IR light transmitter, and IR light sensors 724 each contain an IR light receiver. When an IR light 722 transmits an IR signal, a number of IR light sensors 724 do or do not receive the signal. A location of a waste blockage is determined dependent on IR signal strength, which IR light sensors 724 receive the IR signal, reflectivity of walls of trap 704, positioning of IR lights 722 and IR light sensors 724, and orientations of IR lights 722 and IR light sensors 724. Based upon this determination, certain nozzles 708 actuate to break up the waste blockage.

In some embodiments, toilet trap 704 includes a number of IR lights 722 equal to a number of IR light sensors 724. Each IR light 722 is included in an IR pair with an IR light sensor 724. In some further embodiments, each IR pair is set to send and receive a specific IR wavelength. In some other embodiments, toilet trap 704 includes a number of IR lights 722 which isn't equal to a number of IR light sensors 724.

Figure 8:
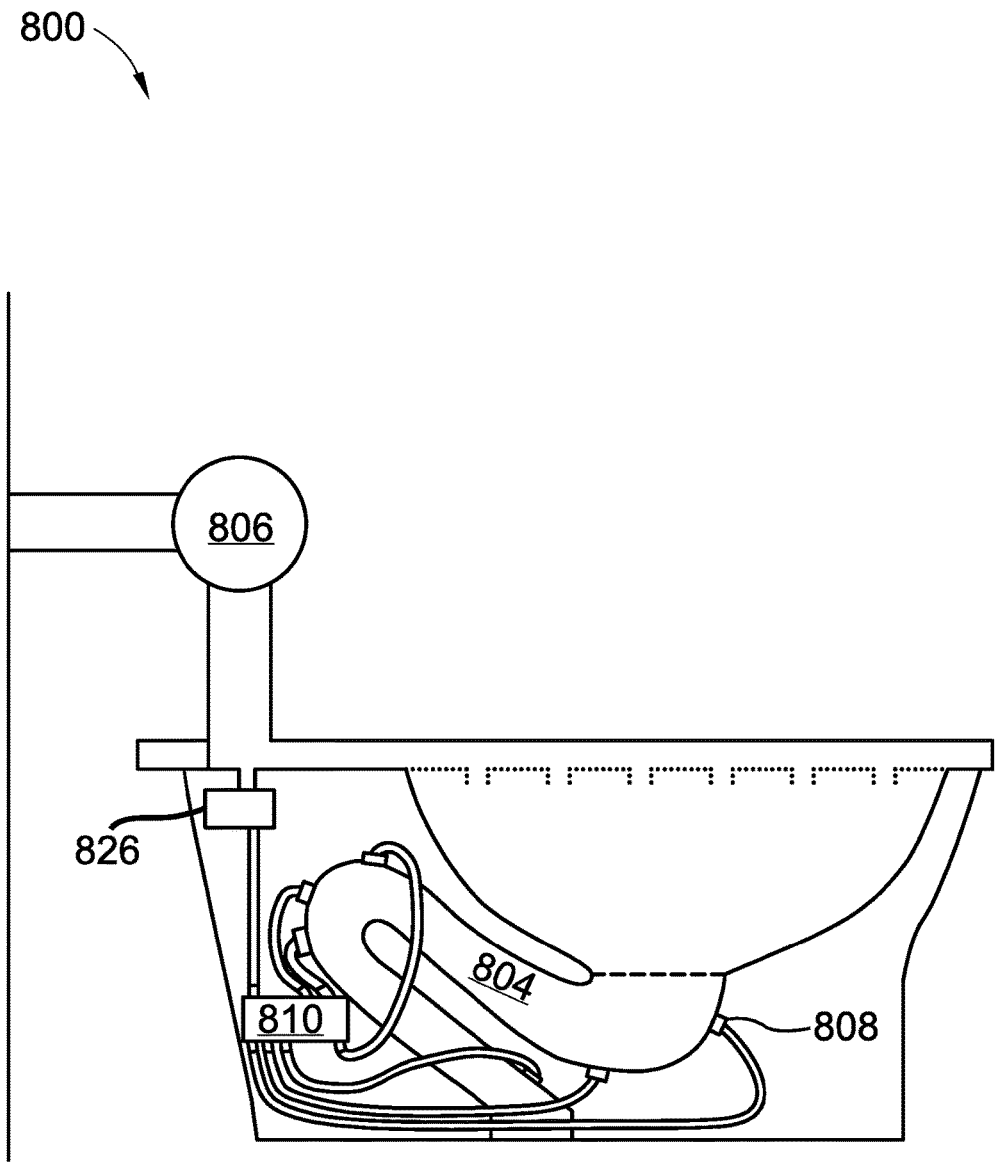
FIG. 8 depicts an embodiment similar to FIG. 1, additionally including a pump.

FIG. 8 depicts an embodiment similar to FIG. 1, additionally including a pump. Toilet apparatus 800 includes water supply 806 and toilet trap 804. Toilet trap 804 includes a plurality of oscillating water jet nozzles 808. Water supply 806 includes pump 826 and one or more controllable water valves 810. Pump 826 includes an inlet and one or more outlets. Toilet trap 804 includes oscillating water jet nozzles 808. Pump 826 pressurizes water between water supply 806 and nozzles 808. Subsequently, nozzles 808 inject the pressurized water into toilet trap 804. In some embodiments, water supply 806 has a water pressure magnitude which isn't high enough for nozzles 808 to inject water with a high enough kinetic energy to effectively break up waste blockages. It is for this reason that pump 826 increases water pressure.

Figure 9:
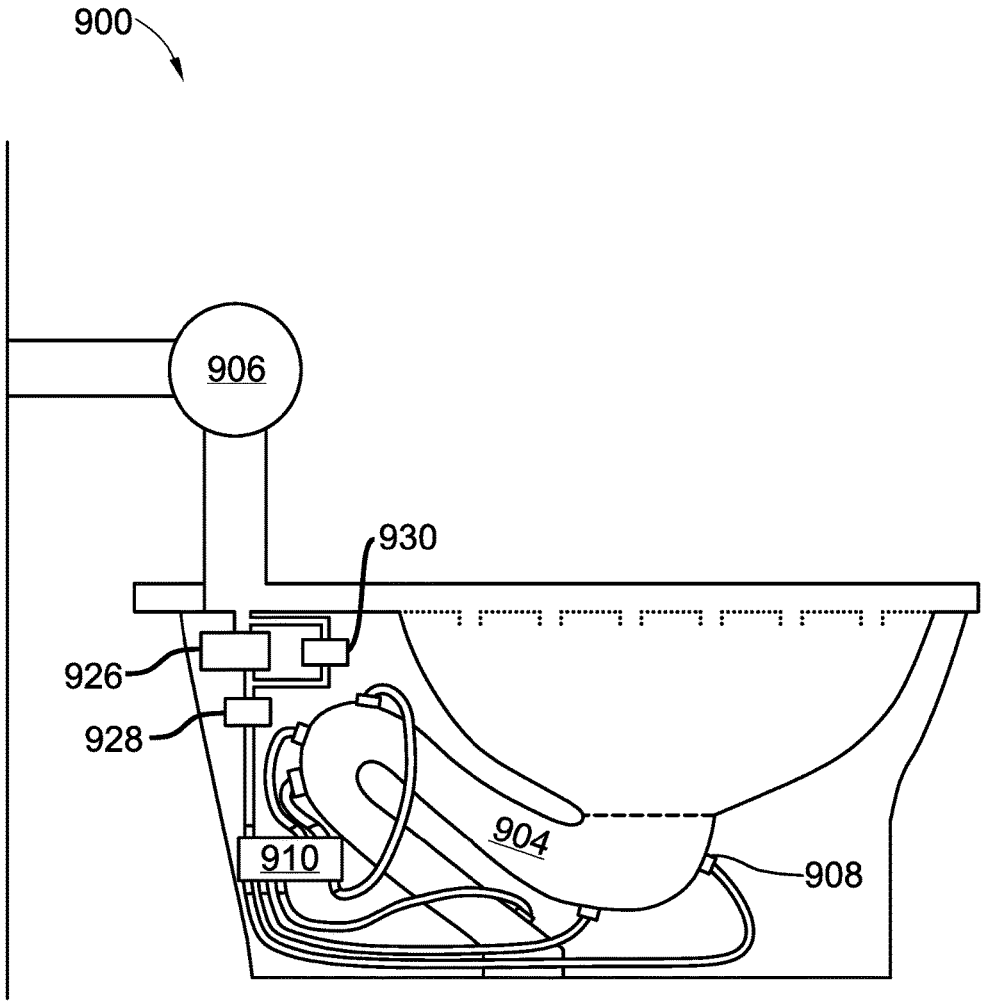
FIG. 9 depicts an embodiment similar to FIG. 8, additionally including a pressure regulator and valve.

FIG. 9 depicts an embodiment similar to FIG. 8, additionally including a pressure regulator and valve. Toilet apparatus 900 includes water supply 906, toilet trap 904, pressure regulator 928, pressure relief valve 930. Toilet trap 904 includes a plurality of oscillating water jet nozzles 908. Water supply 906 includes pump 926 and one or more controllable water valves 910. Pump 926 includes an inlet and one or more outlets. Toilet trap 904 includes a plurality oscillating water jet nozzles 908. As shown, pressure regulator 928 and pressure relief valve 930 communicate fluidly with one or more of the same outlets of pump 926. Pressure regulator 928 additionally communicates fluidly with the plurality of controllable water valves 910, while pressure relief valve 930 communicates fluidly with the inlet of pump 926. When water pressure in one or more outputs of pump 926 reach a threshold pressure, pressure regulator 928 stops excess pressure from reaching controllable water valves 910. Pressure relief valve 930 lowers the water pressure of the outlet of pump 926 by opening, allowing the pressurized water to flow into the inlet of pump 926; this continues until the water pressure is low enough at the outlet of pump 926 that pressure relief valve 930 closes.

For example, in some embodiments, the threshold pressure is 120 pounds per square inch (psi). When the pressure in the outlet of pump 926 is higher than 120 psi, pressure regulator 928 is open enough to let water at 120 psi through it, and as a result, the water pressure of water in controllable water valves 910 is 120 psi. By-pass valve 930 divers water around pump 926 when the supply water pressure is all that is needed to clear a blockage or a lower pressure option is selected by a user.

In some embodiments, pump 926 includes a pressure sensor positioned at an outlet of pump 926. When water pressure at the outlet of pump 926 reaches a determined water pressure level, pump 926 slows down and/or shuts off. This can save power and prevent pump 926 from overly pressurizing the outlet of pump 926, and any connecting piping.

In some embodiments, pump 926 is an electrical pump. In some other embodiments, pump 926 is manually actuated.

Figure 10A:
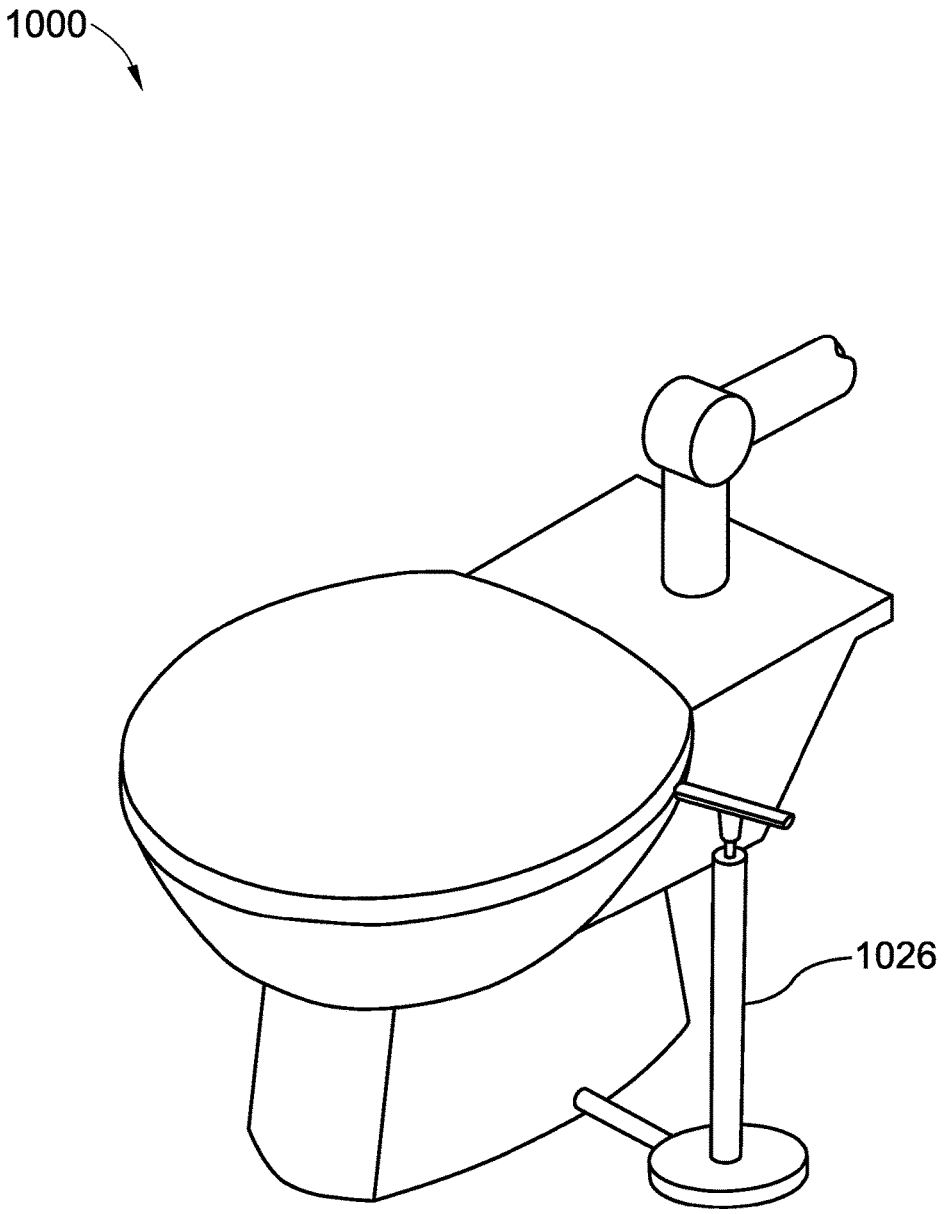
FIG. 10A depict a perspective view of a manually actuated waste fragmenting toilet apparatus.
Figure 10B:
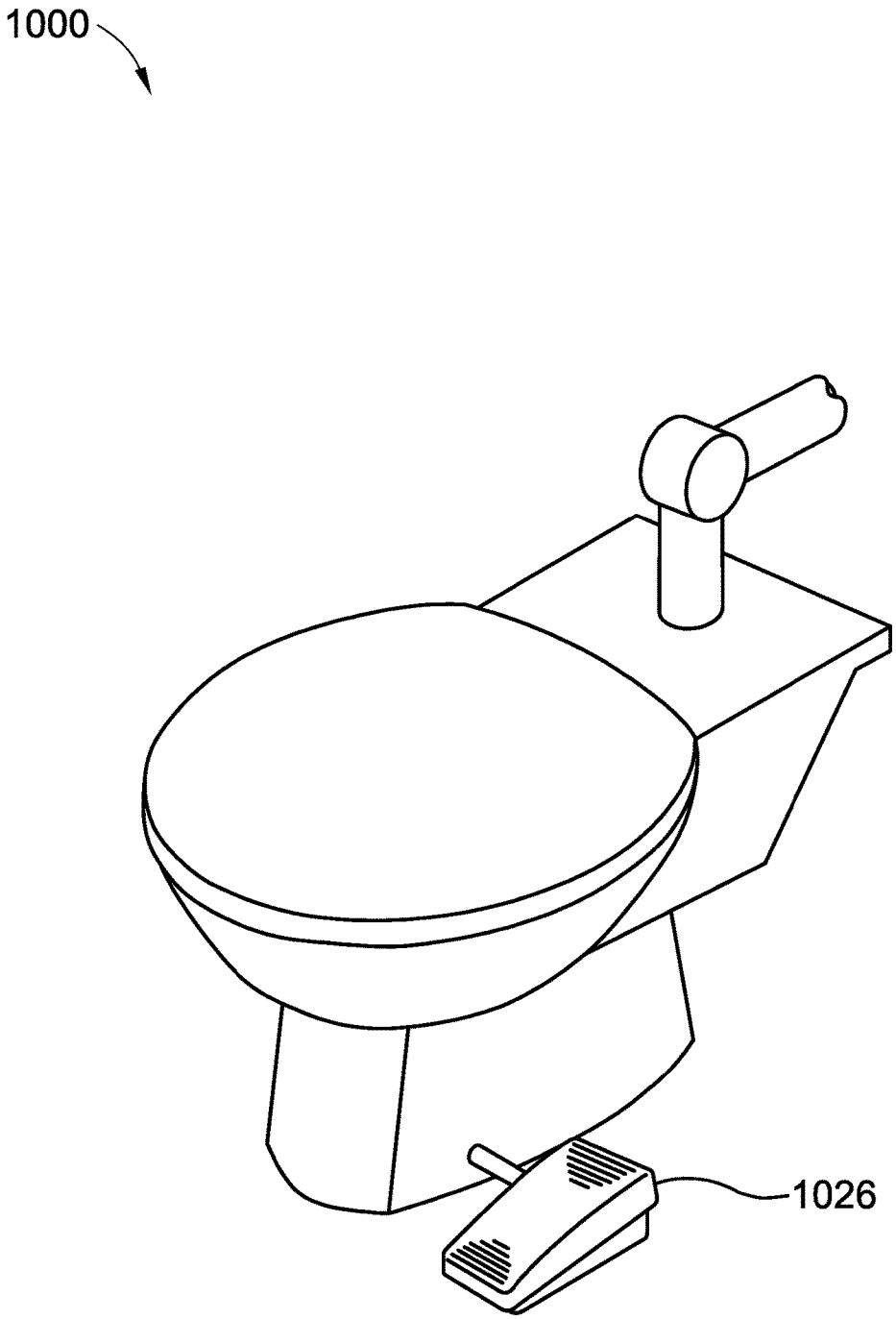
FIG. 10B depict perspective view of a manually actuated waste fragmenting toilet apparatus.

FIG. 10A and FIG. 10B depict perspective views of a manually actuated waste fragmenting toilet apparatus. Toilet apparatus 1000 includes a manually actuated hand pump 1026. As shown in FIG. 10A, the depicted embodiment includes a manual pump 1026 which is easily actuated by a user using his or her hands. As shown in FIG. 10B, the depicted embodiment includes a manual foot pump 1026 which is easily actuated by a user using one or more of his or her feet. The hand and foot pump may be used to increase water pressure to the oscillating water jets in the toilet.

Figure 11:
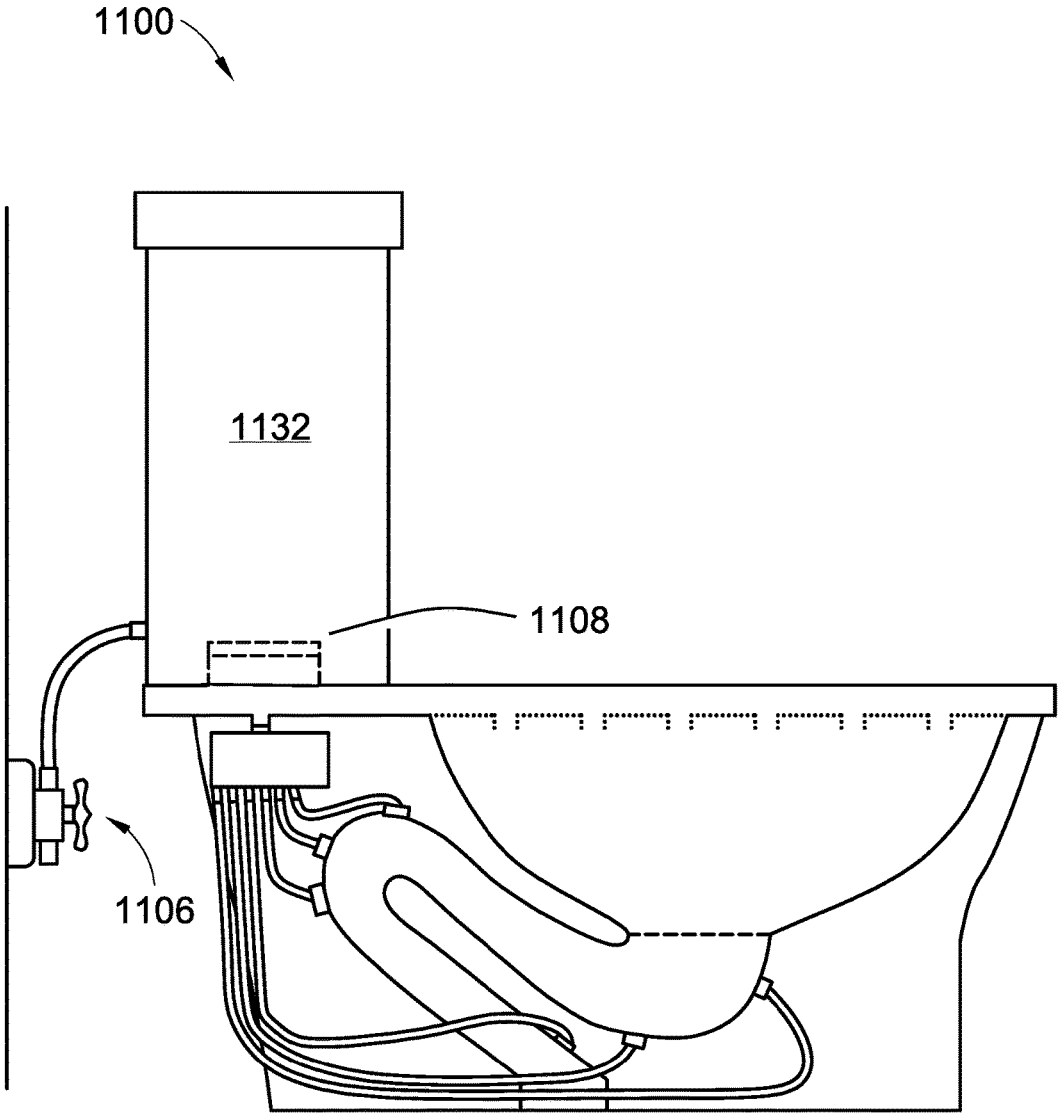
FIG. 11 depicts an embodiment similar to FIG. 1, additionally including a water tank.

FIG. 11 depicts an embodiment similar to FIG. 1, additionally including a water tank. Toilet apparatus 1100 includes water supply 1106 and toilet trap 1104. Water supply 1106 includes water tank 1132. Water tank 1132 fluidly communicates with water supply 1106 such that water tank 1132 stores water from water supply 1106. Water tank 1132 may include a water pump 1108 for increasing water pressure within tank 1132 before delivery through the oscillating water jets.

Figure 12A:
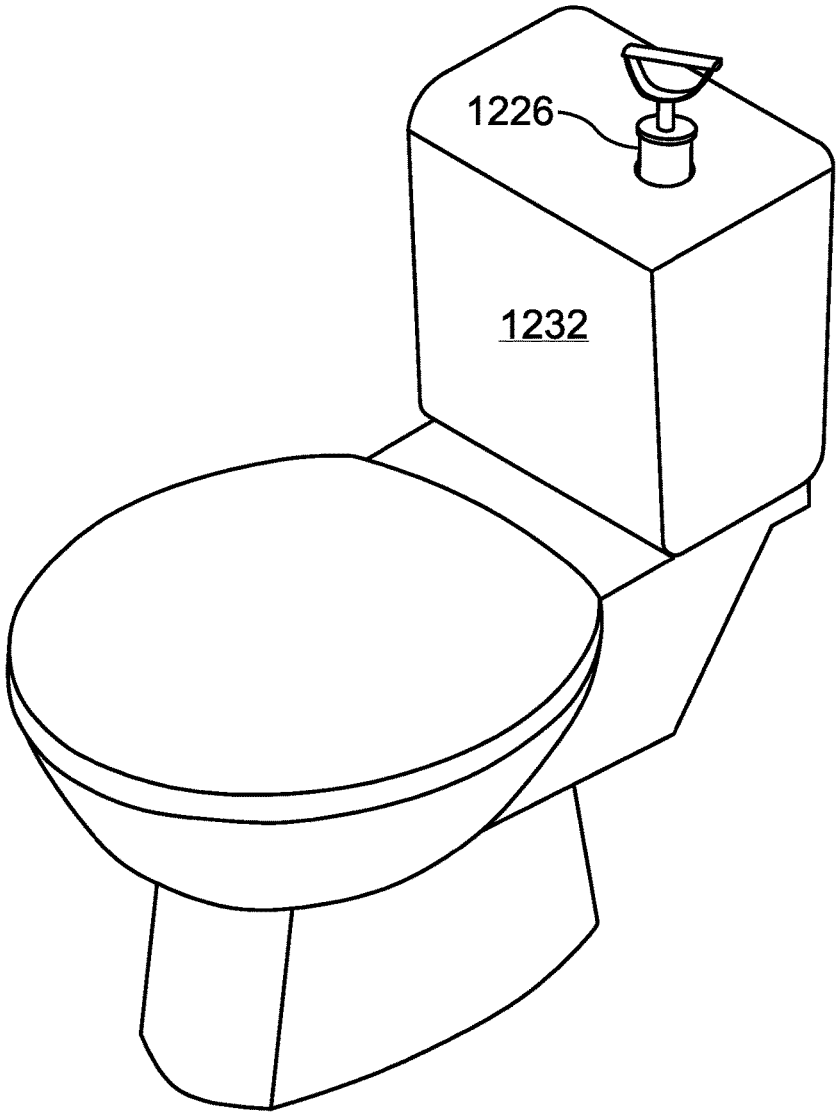
FIG. 12A depicts a perspective view of a waste fragmenting toilet apparatus with a pump inside a water tank.
Figure 12B:
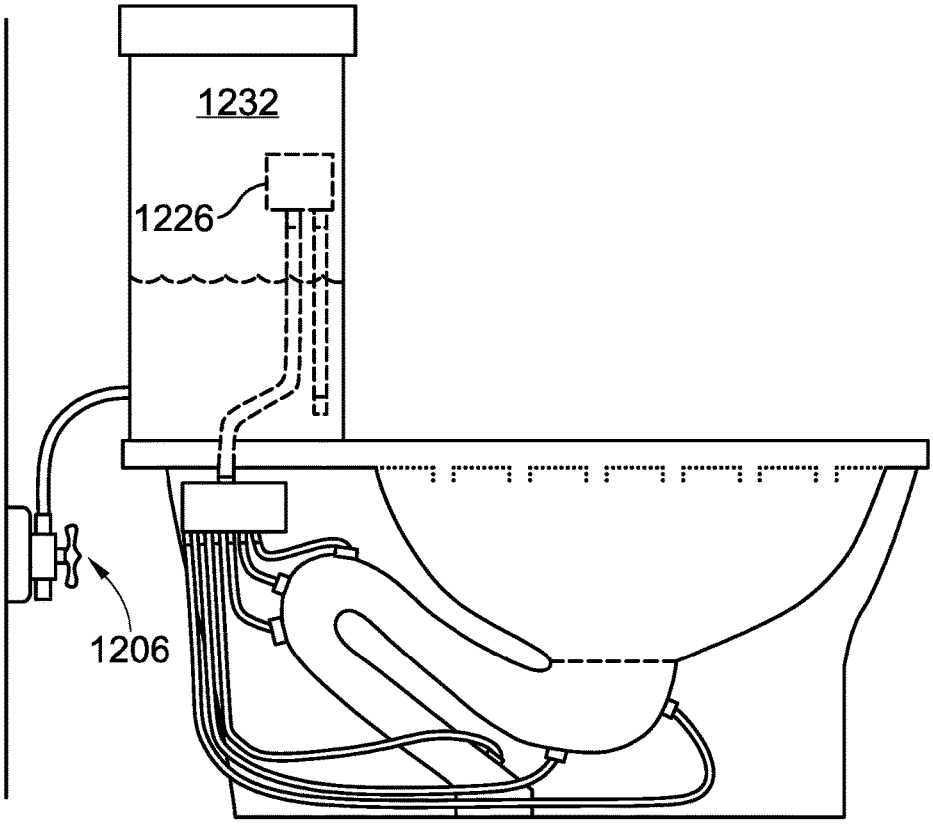
FIG. 12B depicts a side view of a waste fragmenting toilet apparatus with a pump inside a water tank.

FIG. 12A and FIG. 12B depict a perspective view and a side view, respectively, of a waste fragmenting toilet apparatus with a pump inside a water tank. Toilet apparatus 1200 includes water supply 1206. Water supply 1206 includes water tank 1232 and pump 1226. In some embodiments, as depicted in FIG. 12B, pump 1226 communicates fluidly with water tank 1232. Water stored in water tank 1232 flows, due to a pressure difference, through pump 1226. In another embodiment, pump 1226 fluidly communicates directly with water supply 1206. In one embodiment, as depicted in FIG. 12A, water tank 1232 includes an orifice, inside which pump 1226 is at least partially seated, such that pump 1226 is actuated from outside water tank 1232.

Figure 13:
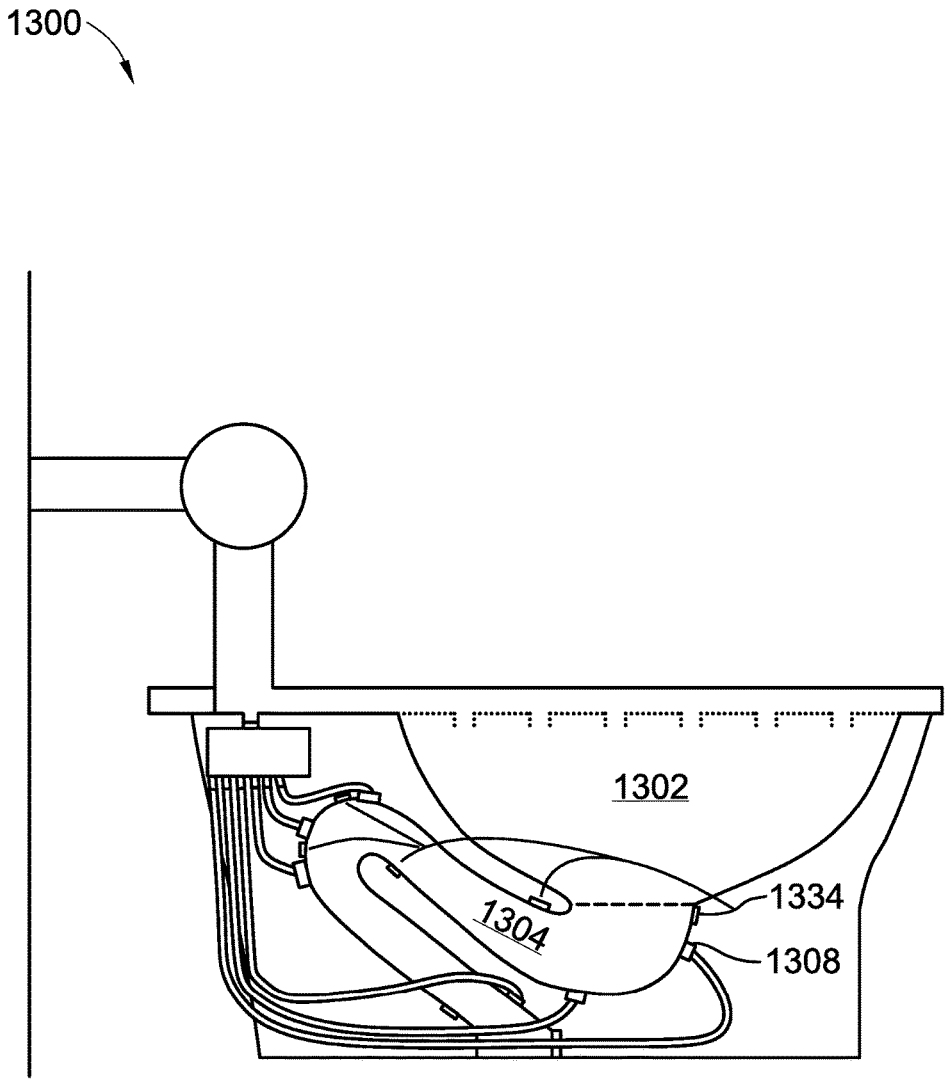
FIG. 13 depicts an embodiment similar to FIG. 1, additionally including pressure sensors.

FIG. 13 depicts an embodiment similar to FIG. 1, additionally including pressure sensors. Toilet apparatus 1300 includes toilet trap 1304 and toilet bowl 1302. Toilet trap 1304 includes a plurality of oscillating water jet nozzles 1308 and pressure sensors 1334 positioned on one or more walls of toilet trap 1304. Pressure sensors 1334 read different pressures around a blockage than they normally would when no blockage is present. In this way, the location of a waste blockage in toilet trap 1304 can be determined, and nozzles 1308 are actuated where the blockage is located to break it up. For example, in some embodiments, when a toilet is flushed a water level within toilet bowl 1302 increases due to a waste blockage, which doesn't allow water to leave the system. The increased water level applies a greater than normal pressure to pressure sensors 1334 and to walls of toilet trap 1304 at a toilet bowl side of the waste blockage. The water pressure at a drain side of the waste blockage will be less than normal or the same.

The invention claimed is:

1. A waste fragmenting toilet apparatus comprising;

a toilet bowl comprising a bottom;

a toilet trap which is coupled to the bottom of the toilet bowl, wherein the toilet trap comprises a plurality of oscillating water jet nozzles positioned at intervals along the toilet trap, wherein an angle of each of the plurality of oscillating water jet nozzles changes sequentially or selectively according to a location of a waste blockage;

a water supply comprising one or more controllable water valves that control water flow to the plurality of oscillating water jet nozzles, wherein the plurality of oscillating water jet nozzles injects pressurized water into the toilet trap;

a plurality of pressure sensors positioned along the toilet trap in locations between each of the plurality of oscillating nozzles; and a microcontroller comprising instructions stored thereon for determining a location of the waste blockage based on a plurality of readings from the plurality of pressure sensors.

2. The waste fragmenting toilet apparatus of claim 1, wherein the toilet bowl comprises one or more oscillating water jet nozzles positioned along the toilet bowl, wherein the one or more oscillating water jet nozzles inject pressurized water into the toilet bowl.

3. The waste fragmenting toilet apparatus of claim 1, wherein the plurality of pressure sensors comprise capacitive sensors positioned on or in walls of the toilet trap.

4. The waste fragmenting toilet apparatus of claim 1, wherein the water jet nozzles actuate in response to the toilet apparatus flushing.

5. The waste fragmenting toilet apparatus of claim 1, further comprising one or more control buttons which actuate the water jet nozzles when depressed.

6. The waste fragmenting toilet apparatus of claim 1, further comprising an enzyme reservoir, and wherein the water jet nozzles inject a mixture of an enzyme from the enzyme reservoir and water from the water supply.

7. The waste fragmenting toilet apparatus of claim 1, wherein the water jet nozzles inject pressurized water into the toilet trap in an arcing pattern, cleaning the toilet trap as well as removing waste blockage.

8. The waste fragmenting toilet apparatus of claim 1, wherein the plurality of pressure sensors comprise one or more infrared lights and one or more infrared light sensors.

9. The waste fragmenting toilet apparatus of claim 1, further comprising a valve manifold comprising the one or more controllable water valves, and a plurality of solenoids configured to open and close the one or more controllable water valves.

10. The waste fragmenting toilet apparatus of claim 9, wherein the microcontroller stores instructions for controlling the valve manifold and for opening and closing the plurality of solenoids based on the location of the waste blockage.

11. The waste fragmenting toilet apparatus of claim 1, further comprising a pump having an inlet and one or more outlets.

12. The waste fragmenting toilet apparatus of claim 11, further comprising a pressure regulator and valve which fluidly communicate between the pump outlet and the pump inlet.

13. The waste fragmenting toilet apparatus of claim 11, wherein the pump is a manually actuated pump.

14. The waste fragmenting toilet apparatus of claim 13, wherein the manually actuated pump is located adjacent a base of the toilet bowl.

15. The waste fragmenting toilet apparatus of claim 11, wherein the pump is an electrical pump.

16. The waste fragmenting toilet apparatus of claim 11, wherein the water source comprises a water tank.

17. The waste fragmenting toilet apparatus of claim 16, wherein the pump is located inside of the water tank.

18. The waste fragmenting toilet apparatus of claim 1, wherein the oscillating comprises a sweeping angle between 0 degrees and 90 degrees with respect to a direction which is normal to a surface whereon a respective water jet nozzle of the plurality of water jet nozzles is positioned.

* * * * *